US005411293A

United States Patent [19]

Monzyk

[11] Patent Number: 5,411,293

[45] Date of Patent: May 2, 1995

[54] DOUBLE COVER RING BINDER

[75] Inventor: Debra Monzyk, Manchester, Mo.

[73] Assignee: American Trading and Production Corporation, Baltimore, Md.

[21] Appl. No.: 255,064

[22] Filed: Jun. 7, 1994

[51] Int. Cl.[6] ..... B42D 3/00

[52] U.S. Cl. ..... 281/31; 281/29; 281/37; 402/73; 402/70

[58] Field of Search ..... 281/29, 31, 37, 51; 402/70, 73

[56] References Cited

U.S. PATENT DOCUMENTS

| | | | |
|---|---|---|---|
| 1,023,466 | 4/1912 | Gareis | 281/31 |
| 2,318,192 | 5/1943 | Boelema, Jr. | 281/31 |
| 2,865,659 | 12/1958 | Zimmermann | 281/31 |
| 4,964,508 | 10/1990 | Balsley | 281/31 X |

*Primary Examiner*—Willmon Fridie

*Attorney, Agent, or Firm*—Cohn, Powell & Hind

[57] ABSTRACT

This ring binder (10) includes a first cover (12) and a second cover (14) interconnected by a ring element (16). The first cover (12) is divided into mirror image sections (24) each having a pocket (30) on at least one face (20). The second cover (14) is also divided into mirror-image sections (44) each having a pocket (50) on at least one face (42).

7 Claims, 1 Drawing Sheet

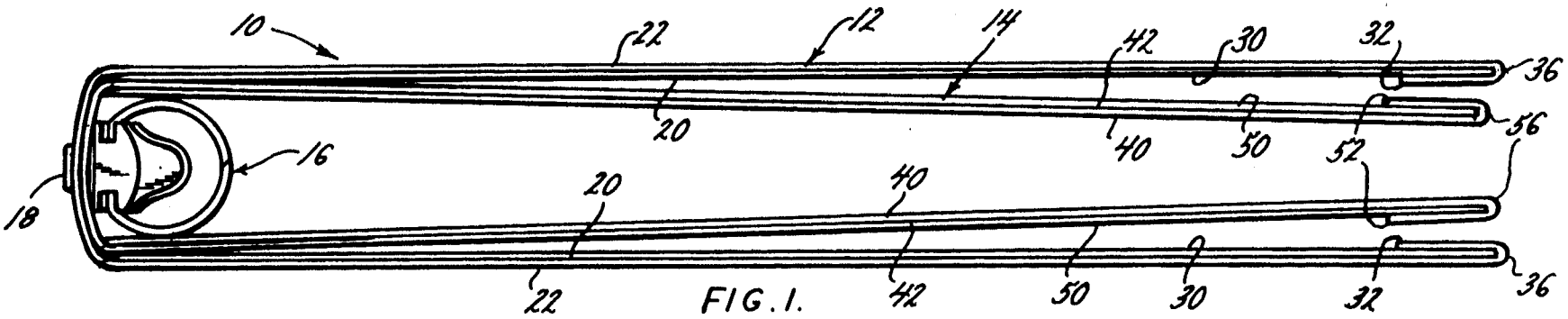
FIG. 1.
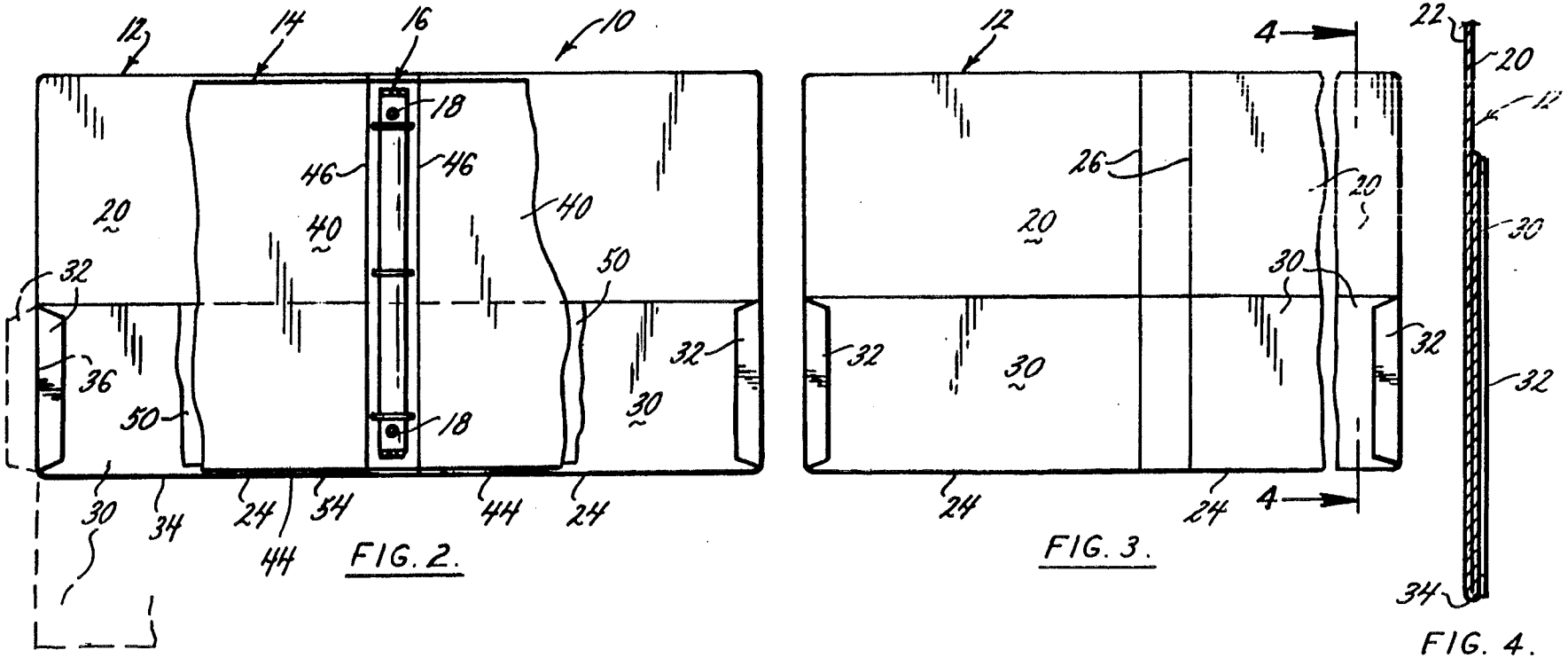
FIG. 2.
FIG. 3.
FIG. 4.

DOUBLE COVER RING BINDER

BACKGROUND OF THE INVENTION

This invention relates generally to binders and more particularly to an improved ring binder with cover pockets providing storage for documents.

One of the most widely used binders is the three ring binder with an elongate three ring element attached inside a single cover with a front and back.

It is common for binders of this type, which are typically used by students, to provide pockets on the inside of the cover to provide temporary storage for loose papers, such as reading assignments and the like. However, the capacity of such pockets is limited and there is a need for additional storage. There is also a problem with pockets of this type in that the papers protruding from the pockets do not provide a suitable writing surface when the user is writing on the note paper contained in the three ring binder.

Separate inserts having pockets which are carried on the rings are known, but such inserts suffer from the disadvantage that they are unstable and further take up valuable space on the ring element.

The present double cover ring binder solves these and other problems in a manner not revealed by the known prior art.

SUMMARY OF THE INVENTION

The present double cover binder has the advantage that it provides additional storage for loose papers and the like, and is particularly useful to students for carrying assignments and the like.

Another advantage is that the double cover ring binder can carry both three holed and non-three holed material in a compact configuration for ease of handling and to minimize bulkiness.

Yet another advantage is that the binder can be formed to provide a convenient, flat surface for the three holed paper in the binder to make writing on the paper easier.

It is an aspect of this invention to provide a double cover ring binder with a first cover including a front face and a rear face; a second cover overlying the first cover and including a front face and a rear face; an elongate ring element; attachment means attaching the elongate ring element and the first and second covers together to divide said covers into opposing side sections; and, means providing a pocket portion on at least one face of each side section of each cover.

It is another aspect of this invention to provide a ring binder in which a pocket portion is provided on the front face of each section of the first cover.

It is still another aspect of this invention to provide a ring binder in which a pocket portion is provided on the rear face of each section of the second cover.

It is yet another aspect of this invention to provide a ring binder in which the covers and pocket portions are formed from a single folded sheet.

Yet another aspect of this invention is to provide a ring binder in which the opposed sections of the second cover front face are free of pocket portions.

Another aspect of this invention is to provide a ring binder in which the pocket portions include opposed edge portions heat sealed to the covers.

It is an aspect of this invention to provide a double cover ring binder which is relatively simple and inexpensive to manufacture and particularly efficient in use.

BRIEF DESCRIPTION OF THE DRAWINGS

FIG. 1 is a top plan view of a double cover ring binder;

FIG. 2 is a front elevational view of the ring binder in the open position;

FIG. 3 is a similar view to FIG. 2 showing only the second cover; and

FIG. 4 is a cross sectional view taken along line 4—4 of FIG. 3.

DESCRIPTION OF THE PREFERRED EMBODIMENT

Referring now by reference numerals to the drawing and first to FIGS. 1 and 2, it will be understood that the double cover ring binder is indicated by numeral 10 and includes a first cover 12 and a second cover 14 interconnected by a sheet binder in the form of an elongate ring element 16. In the embodiment shown, the ring element 16 and the first and second covers 12 and 14 are interconnected by attachment means in the form of rivets 18 extending between the elongate ring element and the two covers.

In the embodiment shown, the covers 12 and 14 are formed from plastic sheet material such as polyethylene which is flexible and capable of being scored as by applying compression to each side to provide fold lines. Such material is, in addition, capable of being heat-sealed to itself.

As shown in FIG. 2, the first, or outer, cover 12 includes a front face 20 and a rear face 22 and is divided into two mirror image sections 24 by the ring element 16 and foldable along score lines 26. It will be understood that the terms "front" and "rear" are related to the view of observer of the front deviational view of the binder in the open position. At the lower end the sections 24 are provided on their front face with pockets 30, which are closed at their outer ends by tabs 32 and effectively closed at their inner ends by the ring element 16. In the preferred embodiment, the pockets 30 are formed by folding the sheet material blank, shown in phantom outline, about a score line 34 which becomes the lower margin of the outer cover 12. The tabs 32 are likewise formed by folding a short outer portion of the sheet material blank about a score line 36 and spot welding, or otherwise attaching, the tab 32 to the pocket 30, to form the closed end of said pocket.

The second, or inner, cover 14 in the preferred embodiment is virtually identical to the first cover 12 and is formed in a virtually identical manner. The second cover includes a front face 40 and a rear face 42 and is divided into two mirror image sections 44 by the ring element 16 and foldable along score lines 46. At the lower end the sections 44 are provided on their rear face with pockets 50 closed at their outer ends by tabs 52 and effectively closed at their inner ends by the ring element 16. In the preferred embodiment, the pockets 50 and tabs 52 are formed in a substantially identical manner to that described above, that is the pockets 50 are formed by folding the sheet material about score lines 54 and the tabs 52 are formed by folding the sheet material about score lines 56. The result of this arrangement is that the pockets 30 and 50 face each other. Also in this arrangement the front face 40 of the inner cover 14 is clear of pockets 50 presenting an uninterrupted backing sheet to facilitate writing on ring binder note paper disposed on said surface.

In the embodiment shown, the first and second covers 12 and 14 are attached by the ring element 16, as discussed above, such that the pockets 30 and 50 are facing each other. However, the second cover 14 may be reversed so that the pockets 50 are formed on the front face 40. Similarly, the first cover 12 may be reversed so that the pockets 30 are formed on the rear face 22. Also if desired pockets could be formed on additional faces, i.e., on the rear face 22 of the outer cover 12 and on the front face 40 of the inner cover 14.

Also it will be understood that the double covers may be constructed from any combination of flexible and hard-backed material and from materials such as vinyl, paper, pressboard, leather and the like, in addition to polyethylene.

Although the invention has ben described by making detailed reference to a single preferred embodiment, such detail is to be understood as instructive, rather than in any restrictive sense, many variants being possible within the scope of the claims hereunto appended.

I claim as my invention:

1. A double cover ring binder comprising:

(a) a first cover including a front face and a rear face;

(b) a second, inner cover overlying said first cover and including a front face and a rear face;

(c) an elongate ring element;

(d) attachment means attaching said elongate ring element and said first and second covers together to divide said covers into opposing side sections; and, (e) means providing a pocket portion on at least one face of each side section of at least the second, inner cover.

2. A double cover ring binder comprising:

(a) a first cover including a front face and a rear face;

(b) a second cover overlying Said first cover and including a front face and a rear face;

(c) an elongate ring element;

(d) attachment means attaching said elongate ring element and said first and second covers together to divide said covers into opposing side sections; and, (e) means providing a pocket portion on at least one face of each side section, including at least, (f) a pocket portion being provided on the front face of each section of said first cover.

3. A ring binder as defined in claim 2, in which:

(g) a pocket portion is provided on the rear face of each section of said second cover.

4. A double cover ring binder comprising:

(a) a first cover including a front face and a rear face said cover being divided into opposed side sections, each side section including at least one pocket portion, said cover and said pocket portion being formed from a single folded sheet;

(b) a second cover overlying said first cover and including a front face and a rear face said cover being divided into opposed side sections, each side section including at least one pocket portion, said cover and said pocket portion being formed from a single folded sheet, (c) an elongate ring element; and, (d) attachment means attaching said elongate ring element and said first and second covers together to divide said covers into said opposed side sections.

5. A ring binder as defined in claim 4, in which:

(e) said first cover pocket portions are provided on the front face of each section of said first cover; and, (f) said second cover pocket portions are provided on the rear face of each section of said second cover.

6. A ring binder as defined in claim 5, in which:

(g) said opposed sections of said second cover front face are free of pocket portions.

7. A ring binder as defined in claim 4, in which:

(e) said pocket portions include opposed edge portions heat sealed to said covers.

* * * * *